United States Patent [19]

Kirkland

[11] Patent Number: 4,675,912

[45] **Date of Patent: * Jun. 30, 1987**

[54] DIRECTLY REPLACEABLE SHOULDER PADDING FOR FOOTBALL AND THE LIKE

[75] Inventor: Alvin E. Kirkland, Los Angeles, Calif.

[73] Assignee: Conlin Bros., Inc., Whittier, Calif.

[ * ] Notice: The portion of the term of this patent subsequent to Nov. 26, 2002 has been disclaimed.

[21] Appl. No.: 839,370

[22] Filed: Mar. 14, 1986

[51] Int. Cl.[4] ..... A41D 13/00

[52] U.S. Cl. ..... 2/2; 2/DIG. 6

[58] Field of Search ..... 2/2, DIG. 6, 268

[56] References Cited

U.S. PATENT DOCUMENTS

| | | | |
|---|---|---|---|
| 3,257,666 | 6/1966 | Hoffman | 2/2 |
| 3,991,420 | 11/1976 | Savarino | 2/2 |
| 4,100,621 | 7/1978 | Ettipio | 2/DIG. 6 |
| 4,455,684 | 6/1984 | Johnson | 2/2 |
| 4,512,037 | 4/1985 | Vacanti | 2/2 |
| 4,554,681 | 11/1985 | Kirkland | 2/2 |

*Primary Examiner*—Louis K. Rimrodt

*Attorney, Agent, or Firm*—William H. Maxwell

[57] ABSTRACT

A quickly replaceable padding for athletic gear and the like, comprised of a depressible core coextensively bonded within an envelope of impervious sanitary material and to which a first element of a hook and loop fastener is anchored by sewing to a doubler coextensively bonded between the core and envelope, the padding being attached by securement to an overlying structural member to which a second element of the hook and loop fastener is attached, thereby establishing primary high shear anchorage that holds the pad in position, and in each instance held against separation by secondary securement repeatedly enforced by compressive forces applied through overlying garments.

4 Claims, 9 Drawing Figures

(LOOP)

(HOOK)

DIRECTLY REPLACEABLE SHOULDER PADDING FOR FOOTBALL AND THE LIKE

BACKGROUND

This invention relates to the sport of football wherein the players wear protective gear comprised of structural members lined with padding. Included in such gear are knee pads, elbow pads and shoulder pads which are the principal subject of this invention. Heretofore, the padding which lines these protective gear has been sewed into place, by heavy stitching passed through the structural members of sheet material shaped to contours overlying the body parts of the athletes to be protected. In practice, the overlying structural members were fiber material in the past, and at the present day they are formed of high density polyethelene plastic, or the like. By sewing the padding into a secure position at the interior or said structural members, a permanent installation is obtained, but totally secure and immoveable so that replacement is next to impossible on a practical basis. In practice, replacement of sewed together pad construction is resorted to only at wide intervals of time, if at all, because of the very high cost of replacement. For example, the sewing must be cut and pulled out piece by piece, and invariably the padding or lining is destroyed and must be renewed, as it becomes irreparable. Accordingly, it is a general object of this invention to provide easily replaceable padding in athletic protective gear. As shown herein, the protective gear is a shoulder pad for football, not to preclude any other kind of similar protective gear with padding or lining.

Football shoulder pads are bilaterally symmetrical and are comprised of right and left arches extending over the shoulders and with anterior and posterior portions overlying the chest and back of the athlete. The posterior portions are permanently hinged together on a vertical axis over the athlete's back or spine, while the anterior portions are connected together on a vertical line over the athlete's sternum as by means of straps or lacing. Alternately, both anterior and posterior portions are permanently hinged together. At least one epaulet and/or shoulder cap extends laterally from each arch, and these too are lined with padding. In each instance the protecting structural member is lined with padding and they are capable of substantial articulation, forming covers in the nature of mail plates with overlapped portions. It is the padding or inner lining of these various structural members with which this invention is concerned, it being an object to provide for the immediate replaceability of such padding, without the tediousness of cutting out and re-sewing as it has been done throughout the past. In practicing this invention, the padding is made secure without stitching, and without the use of buckles, ties or snaps, yet with security subject to instant replaceability.

The hook-and-loop fastener concept is employed as an anchor wherein hard hook elements at one side of an interface engage soft loop elements at the other side of the interface. It is characteristic that such a fastener has high shear capability in the longitudinal plane of the interface, and rather low tension capability or resistance to separation in a direction vertical to that plane. It is significant that termendous abuse tending to cause separation of any fastener system is continuously existant in athletic gear such as a shoulder pad which is the primary concern herein. That is, the various structural members, hinges, ties and paddings or linings are repeatedly subject to ripping and tearing forces, applied in a multitude of indescribable ways and under high impact loads in combinations of shear and tension, and also compression. The aforesaid hook-and-loop fastener is most satisfactory under both shear and compresssion, not too satisfactory under tension, there being a distinction between tension and compression forces an applied herein. Accordingly, it is an object of this invention to provide an anchor system for gear of the type herein referred to which is efficient and effective under compressive secondary forces, and readily releasable under tension forces. With the present invention, the hook-and-loop fastener provides both primary high shear and secondary compressive anchorage of the padding that does not pull apart or separate as might be expected under severe working conditions.

It is an object of this invention to provide for securement of padding to the flat and contoured undersurfaces of structural members, by means of lamina having high shear engagement secured by a secondary compressive application of the lamina. As will be described, primary securement is ensured by means of a hook and loop engagement, and secondary securement is ensured by means of periodically applied compressive forces inherent in the normal use of athletic gear, all as hereinafter described.

SUMMARY OF THE INVENTION

Athletic gear of the type under consideration is not only subject to abuse that requires replacement and repair, but it is subject to soiling and the development of unsanitary conditions. Not only is there soiling by dirt and mud, but also by the normal sweat that is excreted by the body functions of the athlete working with extereme physical effort. Heretofore, such athletic gear has been stored in a soiled sweat laden condition and any cleaning thereof has been purely superficial, since the padding has not been removeable from the structural members of the gear. State of the art athletic gear which is not readily dissassembled is not conducive of good hygiene, and the oderous gear maintained in dirty condition for weeks on end is in reality deliterious to health, and all of which is a prime consideration in athletics.

Therefore in view of the foregoing, it is an object of this invention to provide easily replaceable padding in athletic gear, padding that can be immediately and easily removed and then reaplied or replaced, through simple manipulation of primary and secondary securement of hook-and-loop fastener means employed in its usual high shear and compressive condition. A feature of this invention is the impervious encapsulated nature of the padding per se, each padding being a replaceable component of closed cell plastic in an envelope of impervious plastic impregnated fabric, and all of which is conductive to durability and to sanitary conditioning, especially in that the padding is removeable with facility for regular cleaning, replacement and repair.

The various objects and features of this invention will be fully understood from the following detailed description of the typical preferred form and application thereof, throughout which description reference is made to the accompaying drawings.

Figure 8:
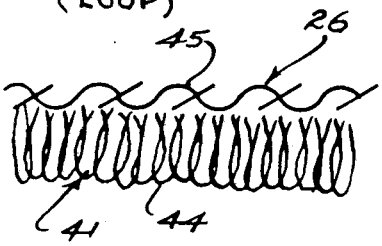
Figure 9:
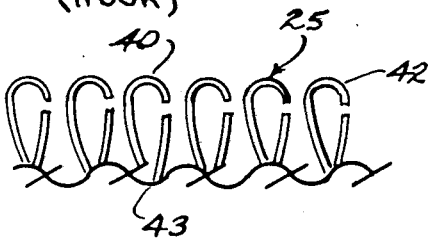

And, FIGS. 8 and 9 are enlarged detailed fragmentary views of the hook-and-loop securement means as it is employed herein.

PREFERRED EMBODIMENT

Referring now to the drawings, a shoulder pad is shown as it is comprised of protective structural members and underlying padding. The principle structural member is the body arch A that extends over the shoulder, there being right and left arches A and each with a depending posterior portion overlying the chest and with a depending posterior portion overlying the back. In addition there is a cup-shaped shoulder cap C or epaulet that overlies the deltoid muscle of the shoulder, and there is a shoulder flap F that overlaps the hinge space between arch A and cap C and which is characterized by a depending anterior portion that overlies the armpit area and the infra-spinatus, terres minor and terres major muscles. The cap C and flap F are hinged to the connecting portion of the arch A by flexible straps 11 and 12 of substantial width secured by rivets 13, all in the usual manner. Accordingly, the structural members are free to articulate so as to accomodate body movements of the athlete. As shown, the complete shoulder pad is bilaterally symmetrical with right and left body arches A that are permanently joined by wide flexible straps 14 connecting the posterior portions of the arches, said straps 14 overlying the spinal area between the scapulas. The anterior portions of the arches A are releasably connected by lacing 15 tied and adjusted thereby to the girth of the athlete. These structural members A and F as thus far described are state of the art and made of the usual materials with fasteners and reinforcements employed therein as circumstances require.

The padding configurations as they are disclosed herein are also state of the art, but improved with respect to replaceability and with respect to sanitation. Each body arch A, right and left, is interfaced with an carries an underlying arch pad P1, and each shoulder cap C is interfaced with and carried by underlying cap pad P2. Each of these pads is fashioned according to the phyisical requrements of the athlete to be protected thereby, and each pad is adapted to be removeable in accordance with this invention. However, in order to simplify the drawing and following detailed description of the securement means S for anchoring such pads, only the pad P1 will be described as shown and releasably anchored thereby.

The pads P1 and P2 are comprised of open cell foamed plastic contained within a contiguous envelope 17 of impervious fabric. A preferred open cell foamed plastic is a low density polyfoam and a preferred impervious fabric is plastic impregnated nylon. The interface between the exterior surface of layer 16 and the inside of envelope 17 is coextensively contiguous by adhesion or bonding of the two materials together at the interface therebetween. Characteristically, there is no stitching through the pad, the inner and outer faces 18 and 19 of the envelope being joined by stitched binding 20 at the periphery of the pad. In practice, there is a neck roll 20' sewed to the binding 20 at a convexly curved inner edge at the pad P1, to form the neck opening of the assembled shoulder pad. Thus, either face 18 and 19 can be free of any encumberances that would cause discomfort to the wearer. For example, there can be no separation of the envelope 17 from the depressible layer 16, and accordingly no protruding wrinkles can develope such as to cause chaffing against the athlete's body.

Figure 1:
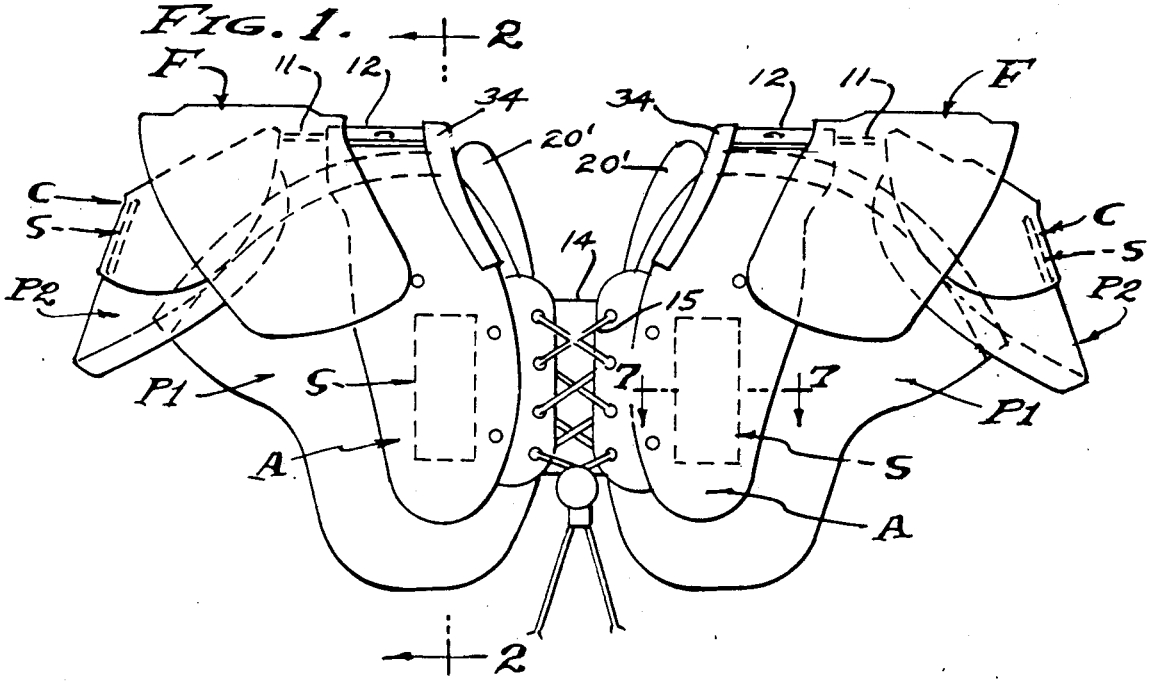
FIG. 1 is a front elevation view illustrating a typical shoulder pad for football and incorporating therein the replaceable shoulder padding of the present invention.
Figure 2:
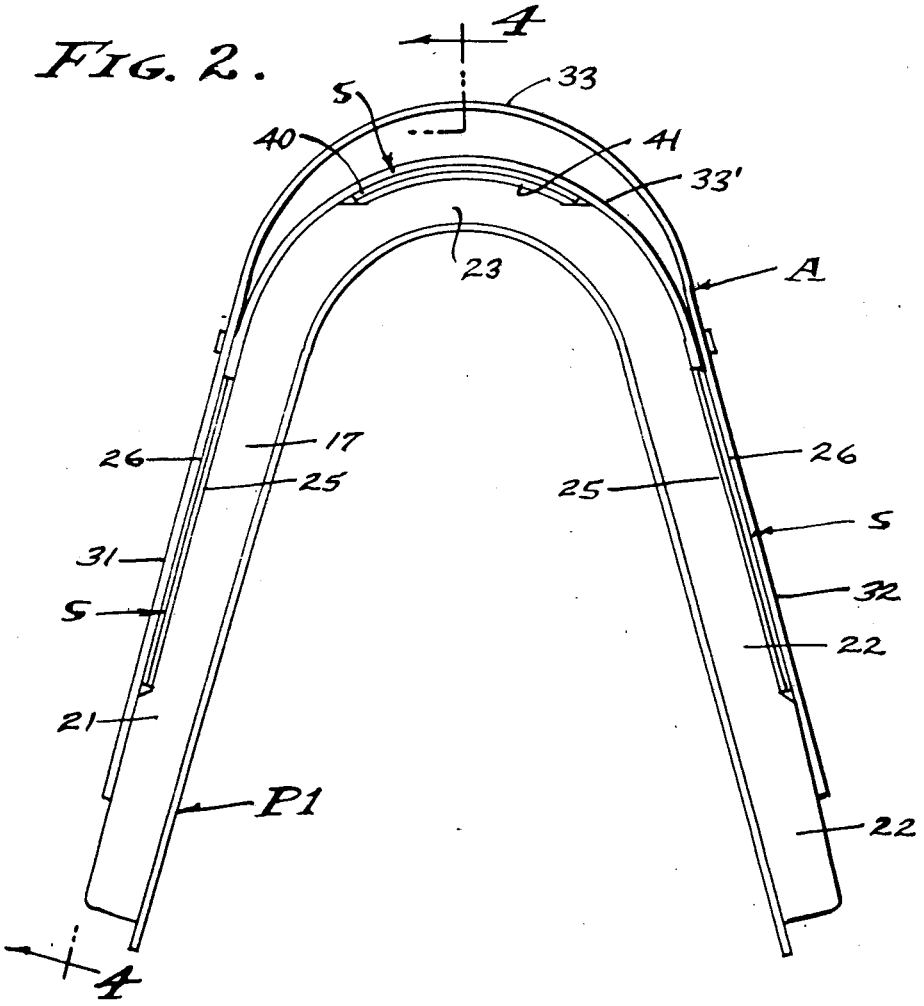
FIG. 2 is an enlarged sectional view taken substantially as indicated by line 2—2 on FIG. 1.
Figure 3:
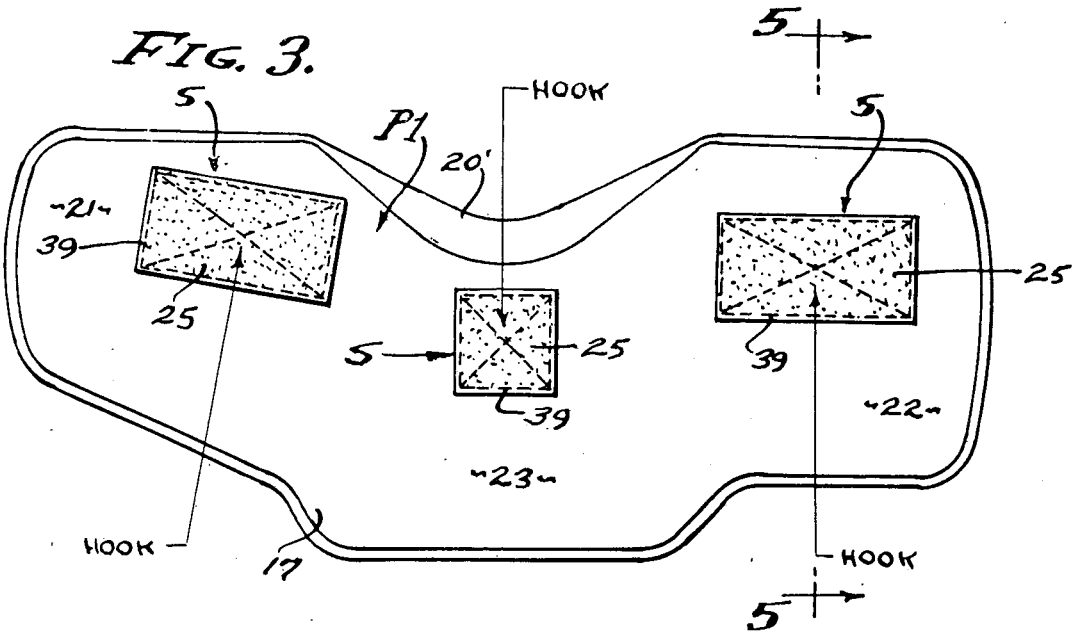
FIG. 3 is a flattened outside view of one of the arch paddings removed from one of the structural members shown in FIG. 1, showing the interface side thereof that is fitted to the inner contours of the arch member.
Figure 4:
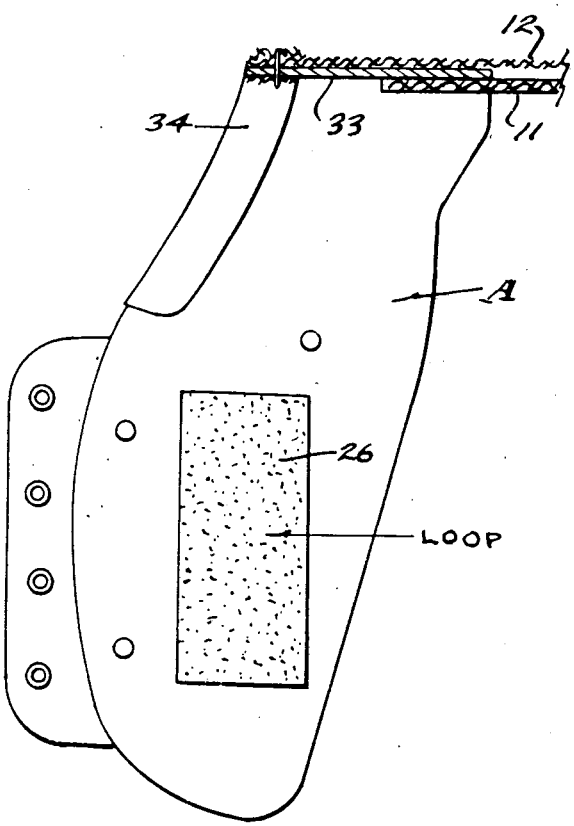
FIG. 4 is an enlarged sectional view of the lefthand arch member taken substantially as indicated by line 4—4 on FIG. 2.
Figure 5:
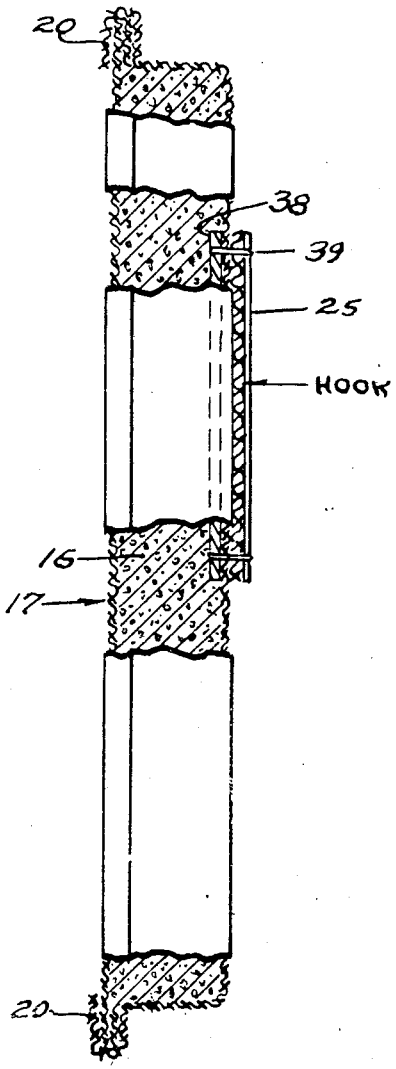
FIG. 5 is an enlarged detailed view taken substantially as indicated by line 5—5 on FIG. 3, and with portions thereof in section.

Referring now to FIG. 3 of the drawings, the left arch pad P1 is shown in its typical configuration having an anterior portion 21, a posterior portion 22, and a connecting shoulder portion 23. The inner face of pad P1 is shown with one of the hook-and -loop elements installed in accordance with this invention. Referring to FIG. 4 of the drawings, the left body arch A is shown separately in its typical configuration, the inside view showing its anterior portion. The inner face of the arch A is shown with the other one of the hook-and-loop elements 26 installed in accordance with this invention. Referring to FIG. 2, the arch pad P1 when installed underlies the body arch A, so that its anterior portion 21 has interface engagement with the inside of the anterior portion of the arch, and so that its posterior portion 22 has interface engagement with the inside of the posterior portion of the arch. Note that the connecting shoulder portion of the pad P1 has some clearance from the overlying complementary portion of the body arch A, where it bears upwardly against an inner arch strap 33' (see FIGS. 2 and 6) for securement as will be described. It is the spaced and interface relationship of the pad and arch that are secured and thereby anchored by the present invention.

In accordance with this invention, the body arch A has an anterior portion 31 complementary to portion 21 of the pad P1, a posterior portion 32 complementary to portion 22 of the pad P1, and a connecting shoulder portion 33 complementary to the portion 23 of the pad P1. The neck opening of the assembled shoulder pad is established by a convexly curved inner edges of the shoulder portions 23 that are each covered by a heavy binding 34. The anterior and posterior portions 31 and 32 are alike and are characteristically of planar configuration.

In accordance with this invention, each fastener element 25 is anchored to the exterior of the pad P1 by a lamination thereto of high density foamed plastic in the form of a relatively thin doubler 38 to which the elements are sewed by stitching 39, prior to assembly with the foamed plastic layer 16. The doubler 38 of higher density foamed plastic such as a high density polyfoam is contiguously adhered or bonded to both the exterior of layer 16 and to the interior of the envelope 17, with margins around the stitching 39. Accordingly, the fastener elements 25 are each securely anchored to a substantial area of the padding P1.

In accordance with this invention, each fastener element 26 is anchored to the interior face of the structural portion 31 or 32, as by adhesion with double sided pressure sensitive tape 27, or the like. In practice there are four such installations on the body arches A , and there are two such installations (not shown in detail) on the shoulder caps C.

Figure 6:
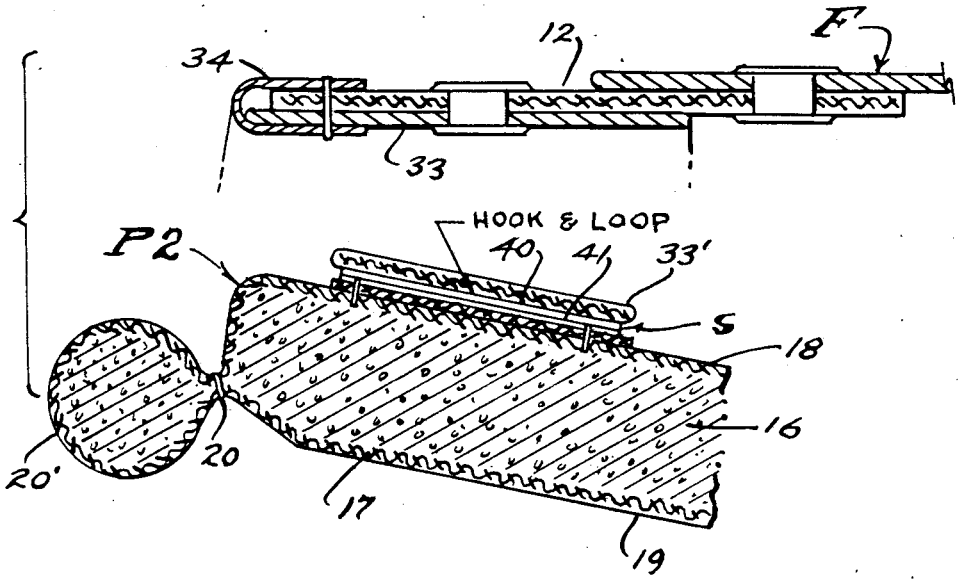
FIG. 6 is an enlarged detailed fragmentary sectional view showing the padding and structural relationship at the top of the arch.
Figure 7:
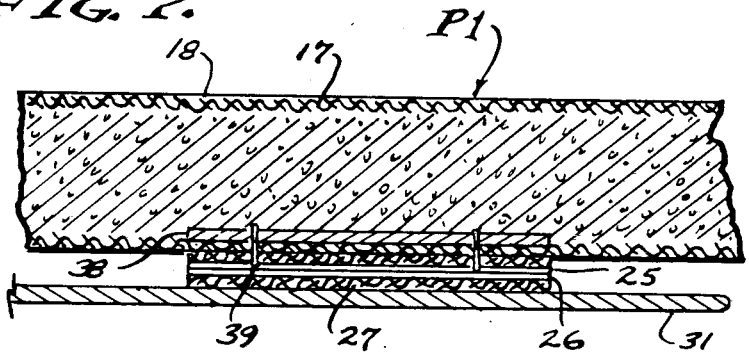
FIG. 7 is an enlarged sectional view showing the assembled hook-and-loop engagement, taken as indicated by line 7—7 on FIG. 1.

In FIGS. 2 and 6 of the drawings, upward positioning of the pad P1 is restricted by the inner strap 33', where pad P1 is secured in position against the inner strap by the hook-and-loop securement S as next described.

In accordance with this invention, the hard hook element 25 of the securement means S faces inwardly, while the soft element 26 thereof faces outwardly, the means S being comprised of a hook element 40 and a loop element 41. The hook element 40 and loop element 41 as shown in FIGS. 8 and 9 are "VELCRO" as manufactured by Velcro USA INC. of 618 Fifth Avenue, New York, N.Y., 10022, or "Scotchmate" as manufactured by 3M Company, St. Paul, MN. 55101, or the like. The hook element 40 (see FIG. 9) of the fastener means S is comprised of a closely arranged multiplicity of minute hooks 42 extending coextensively over and uniformly a short distance from the backing pad or tape 43. The loop element 41 (see FIG. 8) of the fastener means S is comprised of a loop pile of minute fibers 44 of uniform weight, thickness and density, coextensively overlying a backing pad or tape 45. In carrying out this invention, the desired orientation of the flat sided elements 40 and 41 is determined and the hook-and-loop elements pressed into contiguous engagement one with the other for a compressive assembly having its greatest strength in lateral shear.

From the foregoing it will be seen that the protective padding of the present invention is easily replaceable with facility, to the structural members of athletic gear, shown herein as applied to shoulder pads for playing football. The pads are sanitary and they are easily cleaned, as they are comprised of a depressible core or layer within a supple envelope of impervious material or fabric. A feature is the coextensive adhesion or bonding of the envelope to the core layer, and also the reinforced anchorage of the straps that are sewed to doublers coextensively adhered or bonded between the envelope and core layer. Quick and reliable attachment of the padding in working position is by hook-and-loop securement means comprised of primary high shear securement ensured by secondary securement ensured by the prevailing compressive forces inherently applied during use under strenuous working conditions. In each instance the fastener pads are secured in primary overlapped high shear engagement, and in use and under normal abuse and strain, this engagement is enhanced by the secondary compressive forces, and all of which has proven to be effective and reliable, when covered only by the usual light weight shirt or jersy that is worn thereover.

Having described only a typical preferred form and application of my invention, I do not wish to be limited or restricted to the specific details herein set forth , but wish to reserve to myself any modifications or variations that may appear to those skilled in the art as set forth within the limits of the following claims.

I claim:

1. Athletic gear and the like with quickly replaceable padding, and including in combination;

a protective structural member formed to overlie a part to be protected and having an inner face and a protective pad of depressible material shaped and positioned by the structural member and having an interface therewith and disposed between said face of the structural member and the part to be protected and engageable therewith, at least one hook-and-loop fastener means comprised of compressively engageable elements in opposition at said interface and permanently attached to the structural member and to the protective pad respectively and ensuring high shear primary securement inherent by means of secondary compressive forces applied thereto during normal athletic use, and the depressible material of the protective pad being coextensively contiguous to the interior of an envelope and with a doubler disposed therebetween and all of which is coextensively bonded and to which a flexible backing of one hook-and-loop element is anchored.

2. Athletic gear and the like with padding as set forth in claim 1, wherein said flexible backing of said one hook-and-loop element is anchored by sewing through the envelope and doubler.

3. Athletic gear and the like with padding as set forth in claim 1, wherein the doubler is a relatively thin body of higher density plastic than the depressible material , and wherein the envelope bonded thereto is an impervious plastic impregnated fabric.

4. Athletic gear and the like with padding as set forth in claim 1, wherein the doubler is a relatively thin body of higher density plastic than the depressible material , wherein the envelope bonded thereto is an impervious plastic impregnated fabric, and wherein said flexible backing of said one hook-and-loop element is anchored by sewing through the envelope and doubler.

* * * * *